US010056211B2

(12) United States Patent
Hori et al.

(10) Patent No.: US 10,056,211 B2
(45) Date of Patent: Aug. 21, 2018

(54) HEAT-REACTIVE SWITCH

(71) Applicant: UBUKATA INDUSTRIES CO., LTD., Nagoya-shi, Aichi (JP)

(72) Inventors: Tomohiro Hori, Nagoya (JP); Yoshio Yamaguchi, Nagoya (JP)

(73) Assignee: UBUKATA INDUSTRIES CO., LTD., Nagoya-Shi, Aichi (JP)

( * ) Notice: Subject to any disclaimer, the term of this patent is extended or adjusted under 35 U.S.C. 154(b) by 0 days.

(21) Appl. No.: 15/312,636

(22) PCT Filed: May 23, 2014

(86) PCT No.: PCT/JP2014/063705

§ 371 (c)(1),
(2) Date: Nov. 19, 2016

(87) PCT Pub. No.: WO2015/177925

PCT Pub. Date: Nov. 26, 2015

(65) Prior Publication Data

US 2017/0103863 A1 Apr. 13, 2017

(51) Int. Cl.

| | |
|---|---|
| ***H01H 37/34*** | (2006.01) |
| ***H01H 37/04*** | (2006.01) |
| *H01H 85/165* | (2006.01) |

(52) U.S. Cl.

CPC ..... *H01H 37/34* (2013.01); *H01H 37/04* (2013.01); *H01H 85/165* (2013.01); *H01H 2223/002* (2013.01)

(58) Field of Classification Search

CPC ..... H01H 37/34; H01H 37/04; H01H 69/02; H01H 85/165; H01H 9/04; H01H 37/5427;

(Continued)

(56) References Cited

U.S. PATENT DOCUMENTS 4,136,323 A * 1/1979 D'Entremont ..... H01H 61/02 337/102

4,808,960 A * 2/1989 Nixon ..... H01H 61/02 337/102

(Continued)

FOREIGN PATENT DOCUMENTS

| | | |
|---|---|---|
| JP | 2005240596 A | 9/2005 |
| JP | 2007115610 A | 5/2007 |
| JP | 2014059968 A | 4/2014 |

OTHER PUBLICATIONS

Hayashi Kanefusa; Hayashi Mokichi, "Planar Heating Element", Sankei Giken, Entire Document (Full Translation of JP 2007115610, of Record in IDS).*

Ataka Takashi; Hori Tomohiro, "Thermally-Actuated Switch for Sealed Motor Compressor", Ubukata IND Co. LTD, Entire Document (Full Translations of JP 2014059968, of Record in IDS).*

(Continued)

*Primary Examiner* — Jayprakash N Gandhi
*Assistant Examiner* — Stephen Sul
(74) *Attorney, Agent, or Firm* — Karceski IP Law, PLLC

(57) ABSTRACT

A heat-reactive switch includes an airtight container with a housing and a lid plate, two conductive terminal pins fixed in through-holes in the lid plate, a fixed contact point fixed on one of the conductive terminal pins, a heater connected to the other conductive terminal pin and to the lid plate, a heat-reactive plate connected to the housing internal surface, the bending direction becoming inverted at a predetermined temperature, and a mobile contact point provided at the end of the heat-reactive plate. A heating element has a plurality of serpentine portions made from a metal plate in ribbon form, disposed between the lid plate and the heat-reactive plate so as to be parallel thereto. At least two of the serpentine portions are disposed to face each other while sandwiching the conductive terminal pin. Each portion follows the inner peripheral surface of the housing and have planar portions facing each other.

6 Claims, 4 Drawing Sheets

(58) Field of Classification Search
CPC ..... H01H 85/00; H01H 2223/002; H01H 2205/002; H01H 71/20; H01H 3/001; H01H 37/5418; H01H 81/02
USPC ..... 337/298, 205, 14, 16, 100, 102, 103
See application file for complete search history.

(56) References Cited

U.S. PATENT DOCUMENTS 5,015,985 A * 5/1991 Ubukata ..... H01H 37/12 337/107
6,005,471 A * 12/1999 Higashikata ..... H01H 37/5418 337/347
2004/0100351 A1* 5/2004 Unno ..... F04C 23/008 337/100
2009/0315666 A1* 12/2009 Ueda ..... H01H 1/02372 337/298
2011/0025449 A1* 2/2011 Grosskopf ..... H01H 37/5418 337/365

OTHER PUBLICATIONS

International Search Report dated Jul. 1, 2014, for International Patent Application No. PCT/JP2014/063705.
Singapore Office Action dated Jul. 24, 2017, for Singapore Patent Application No. 11201609450S.
Korean Office Action dated Dec. 19, 2017, for Korean Patent Application No. 10-2016-7032689.
Japanese Office Action dated Jan. 9, 2018, for Japanese Patent Application No. 2016-520892.
Chinese Office Action dated Jan. 19, 2018, for Chinese Patent Application No. 2014800791491.
European Office Action dated Feb. 21 2018, for European Patent Application No. 14892404.6.
Mexican Office Action dated Jun. 1, 2018, for Mexican Patent Application No. MX/a/2016/015334.
Japanese Office Action dated Jun. 5, 2018, for Japanese Patent Application No. 2016-520892.
Korean Office Action dated Jun. 21, 2018, for Korean Patent Application No. 10-2016-7032689.

* cited by examiner

HEAT-REACTIVE SWITCH

CROSS-REFERENCE TO RELATED APPLICATIONS

This is a National Stage Entry into the United States Patent and Trademark Office from International PCT Patent Application No. PCT/JP2014/063705, having an international filing date of May 23, 2014, the entire contents of which are incorporated herein by reference.

FIELD OF THE INVENTION

The present invention relates to a heat-reactive switch used as a protective device of a motor or the like.

DESCRIPTION OF RELATED ART

Conventionally, many heat-reactive switches using a heat-reactive body such as bimetal have been proposed as the type of heat-reactive switch mentioned above. A configuration of such a heat-reactive switch as an example will be described with reference to FIGS. 6 and 7. A heat-reactive switch 101 has a metallic housing 102 and a lid plate 103. An airtight container is formed by welding and fixing the lid plate 103 to an opening part of the housing 102. Through holes are provided in the lid plate 103. Metallic conductive terminal pins 104A, 104B are inserted into the through holes. The conductive terminal pins 104A, 104B are fixed in an airtight manner by an electrical insulating material 105 such as glass. A fixed contact 106 is fixed to one conductive terminal pin 104A, on the inner side of the airtight container. One end of a heater 107 as a heating member is connected to the other conductive terminal pin 104B, on the inner side of the airtight container. The other end of the heater is connected to the lid plate 103.

A heat-reactive plate 109 configured of bimetal or the like is connected to the inner side of the housing 102, through a connecting body 110. A movable contact 108 is provided on a movable end of the heat-reactive plate 109. The heat-reactive plate 109 is formed into a shallow plate-shape, and is configured to reverse its curving direction when it reaches a predetermined operating temperature, and recover its curving direction when it reaches a predetermined recovery temperature. Note that the heat-reactive plate 109 normally brings the movable contact 108 into contact with the fixed contact 106, as shown in FIG. 6.

The heat-reactive switch 101 is used in an enclosed electric compressor or the like for compressing a refrigerant of an air conditioner, for example. In this case, the heat-reactive switch 101 is arranged inside an unillustrated closed housing of the compressor, such that the conductive terminal pins 104A, 104B are connected in series with a motor. During operation of the air conditioner, an operating current of the electric compressor flows through the heat-reactive switch 101 connected in the aforementioned manner, by the following route: the conductive terminal pin 104B—the heater 107—the lid plate 103—the housing 102—the connecting body 110—the heat-reactive plate 109—the movable contact 108—the fixed contact 106—the conductive terminal pin 104A. The current flowing in this manner heats the heater 107 and the heat-reactive plate 109 of the heat-reactive switch 101. However, a current flowing during normal operation of the air conditioner keeps the heat-reactive plate 109 equal to or lower than the operating temperature. Hence, the motor continues to be energized.

However, when rotation of the motor is somehow restricted, for example, an overcurrent several times larger than the normal operation current flows through the motor. Hence, if left in this state, components such as coils of the motor may be burned.

If the heating value of the heater 107 and the heat-reactive plate 109 largely exceed the normal state due to the overcurrent, the temperature of the heat-reactive plate 109 rises to the predetermined operating temperature, and the curving direction of the heat-reactive plate 109 will be reversed. Accordingly, the movable contact 108 fixed on a tip end part of the heat-reactive plate 109 moves away from the fixed contact 106. This releases the connection between the movable contact 108 and the fixed contact 106, and interrupts the electric circuit. Thus, when a malfunction occurs in the compressor, the heat-reactive switch 101 releases the connection between contacts, to surely interrupt energization of the motor before coils of the motor reach a burning temperature.

SUMMARY OF INVENTION

When an electric compressor as an object to be protected is small, for example, its energization current is small. For this reason, a heater and a heat-reactive plate cannot generate sufficient heat by itself in the configuration of the conventional heat-reactive switch 101. Hence, measures need to be taken to increase the heating value of the heater and the heat-reactive plate. However, since the kind of metals used as bimetal and tri-metal of the heat-reactive plate is limited, for example, there is a limit to increasing the heating value by improving materials of the heat-reactive plate. Another conceivable method of increasing the heating value is to form the heat reactive-plate thin, to thereby reduce the cross-sectional area and increase the value of resistance. However, since a drive power for opening and closing a movable contact needs to be secured for the heat-reactive plate, there is also a limit to forming the heat-reactive plate thin. Additionally, the kind of metal used as the material of the heater is also limited due to the required physical characteristics such as weldability and cost requirements. Hence, there is substantially a limit to replacing the material of the heater with a material having high resistivity. Hence, the most effective way to increase the heating value of a heat-reactive switch is to reduce the cross-sectional area and stretch the overall length of a heater.

According to a heat-reactive switch of the present invention, a heating element of a heater has multiple meandering portions formed of a strip-shaped metal plate, and is arranged parallel to and between a lid plate and a heat-reactive plate. The meandering portions are: arranged such that at least two of the meandering portions are opposite to each other with a conductive terminal pin interposed therebetween; each aligned with an inner circumferential surface of a housing; and are each bent with respect to a reference axis extending in the longitudinal direction of the housing, so that strip-shaped flat portions face each other.

According to the heat-reactive switch of the present invention, by applying advantageous ideas to the shape of the heater, it is possible to reduce the cross-sectional area and extend the overall length of the heater. Hence, the heating value of the heater can be increased.

DETAILED DESCRIPTION OF EMBODIMENT(S) OF THE INVENTION

Figure 1:
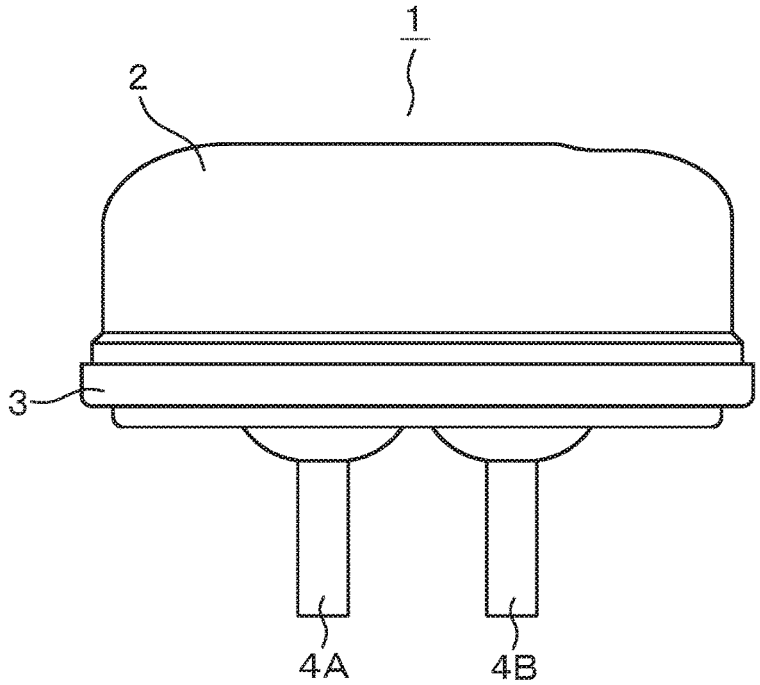
FIG. 1 is a front view of a heat-reactive switch of an embodiment.
Figure 2:
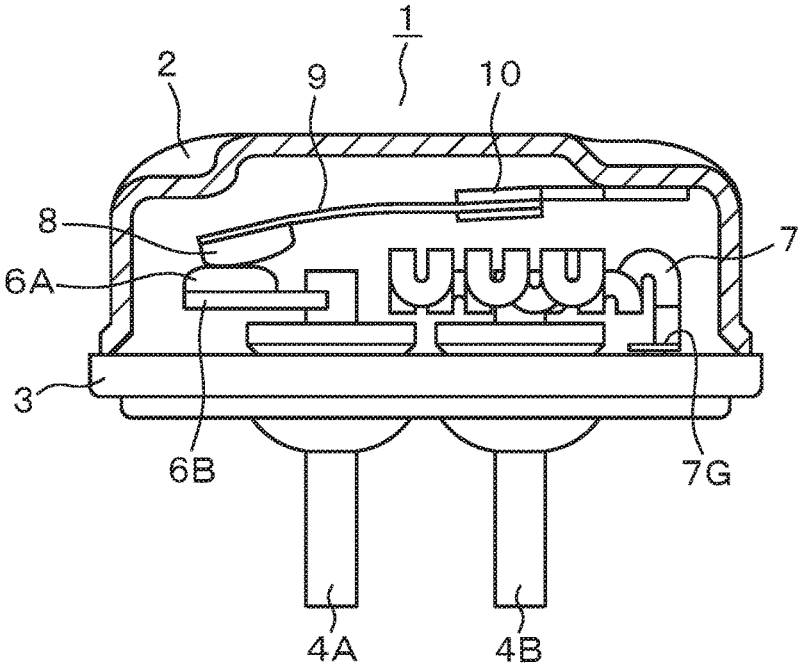
FIG. 2 is a longitudinal section of the heat-reactive switch.

Hereinbelow, a description will be given of an embodiment of a heat-reactive switch to which the present invention is applied, with reference to the drawings. As shown in FIGS. 1 and 2, a heat-reactive switch 1 is an airtight container configured of a metallic housing 2 and a lid plate 3. The housing 2 is formed into a long dome shape having an open end. The lid plate 3 is adhered in an airtight manner to the open end of the housing 2 by welding, for example. Metallic conductive terminal pins 4A, 4B are inserted into two through holes provided in the lid plate 3. These conductive terminal pins 4A, 4B are fixed by an electrical insulating filler such as glass. Thus, the conductive terminal pins 4A, 4B are adhered in an airtight manner, in an electrically insulated state.

A fixed contact 6A is fixed, through a conductive fixed contact support 6B, to a part of one conductive terminal pin 4A on the inner side of the airtight container. Also, a heat-reactive plate 9 configured of bimetal or tri-metal, for example, is fixed to the inner side of the housing 2 through a connecting body 10. The heat-reactive plate 9 is formed into a plate shape by drawing, and has one end connected to an inner surface of the housing 2 through the connecting body 10. The heat-reactive plate 9 reverses its curving direction, when it reaches a predetermined temperature. Also, a movable contact 8 is fixed to a movable end, which is the other end, of the heat-reactive plate 9.

When the heat-reactive plate 9 is reversed, the movable contact 8 moves away from the fixed contact 6A. This releases a connection between the movable contact 8 and the fixed contact 6A, and interrupts an electric circuit formed of: the conductive terminal pin 4B—a heater 7—the lid plate 3—the housing 2—the connecting body 10—the heat-reactive plate 9—the movable contact 8—the fixed contact 6A—the fixed contact support 6B—the conductive terminal pin 4A. Note that in a normal state where the heat-reactive plate 9 is not reversed, the movable contact 8 is in contact with the fixed contact 6A and forms the above electric circuit. Thus, the movable contact 8 opens and closes the electric circuit, by being driven by the heat-reactive plate 9 to come into contact with and separate from the fixed contact 6A.

Figure 3:
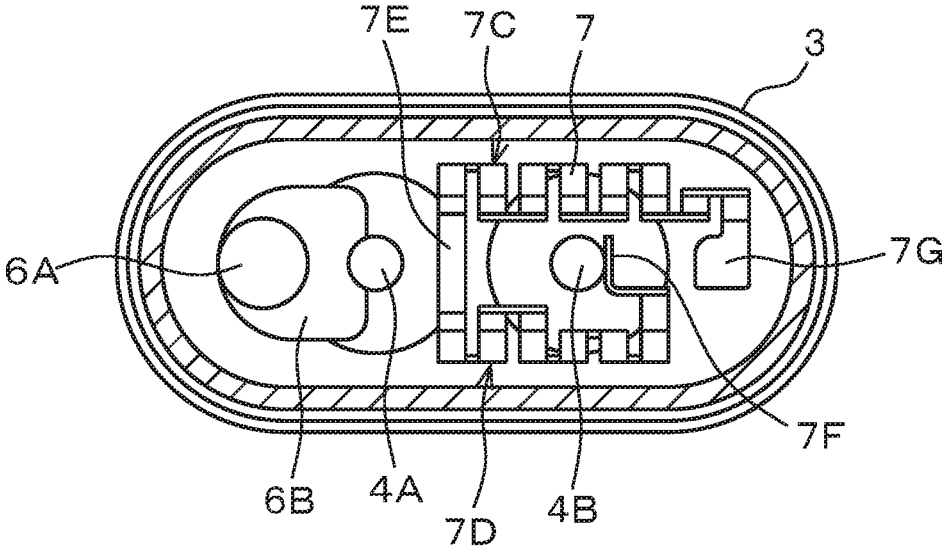
FIG. 3 is a cross-sectional view of the heat-reactive switch.
Figure 4:
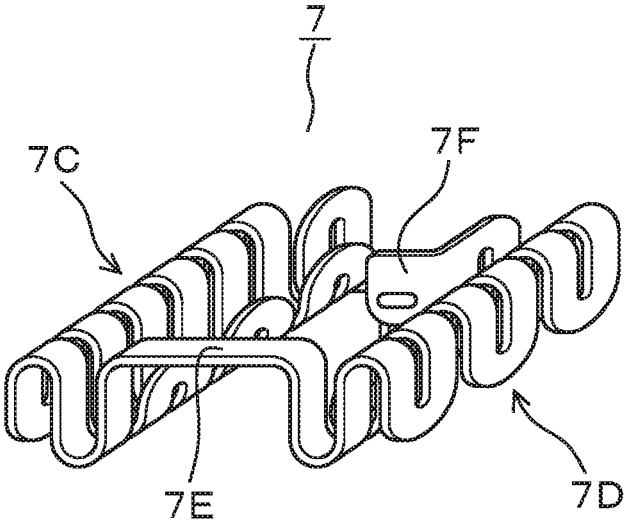
FIG. 4 is a perspective view of a heater.

As also shown in FIG. 3, one end of the heater 7 is connected to a part of the other conductive terminal pin 4B on the inner side of the airtight container. The other end of the heater 7 is connected to an inner surface of the lid plate 3. The shape of the heater 7 will be described with reference to FIGS. 4 and 5. The heater 7 is configured of a metal plate having a certain resistivity and formed into a strip shape by pressing, for example. Also, the heater 7 has meandering portions, and the meandering portions are bent. Specifically, the heater 7 is configured of multiple heater units including a linear portion 7A as a linear heating element, and a semicircular portion 7B as a semicircular heating element. In the heater 7, multiple heater units are alternately connected, by joining the linear portion 7A of one heater unit to the semicircular portion 7B of another heater unit. Thus, the heater 7 has multiple meandering portions 7C, 7D in which multiple linear portions 7A are provided adjacent to one another with the semicircular portion 7B interposed therebetween.

The structure of the heater 7 adopts the meandering heating element, so that a longer electric circuit can be obtained inside a limited space. The meandering portions 7C, 7D are connected by a connection portion 7E. In this case, the connection portion 7E is a linearly extending strip-shaped element. Note, however, that the connection portion 7E may be a meandering part. Additionally, fixing portions 7F, 7G are provided on both end parts of the heater 7.

Figure 5:
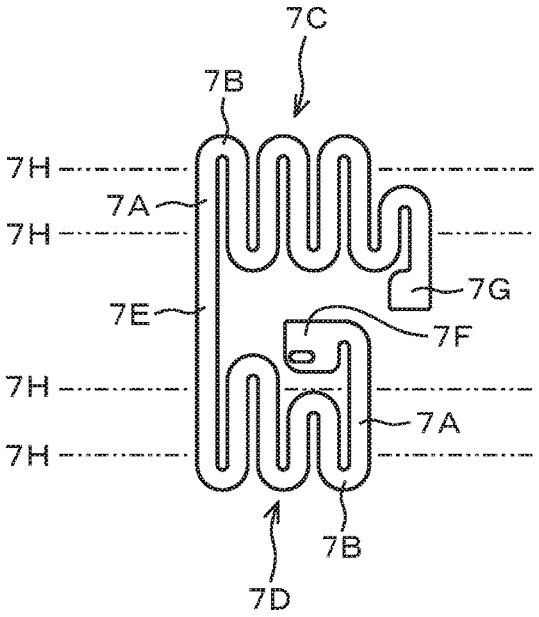
FIG. 5 is a development of the heater.
Figure 6:
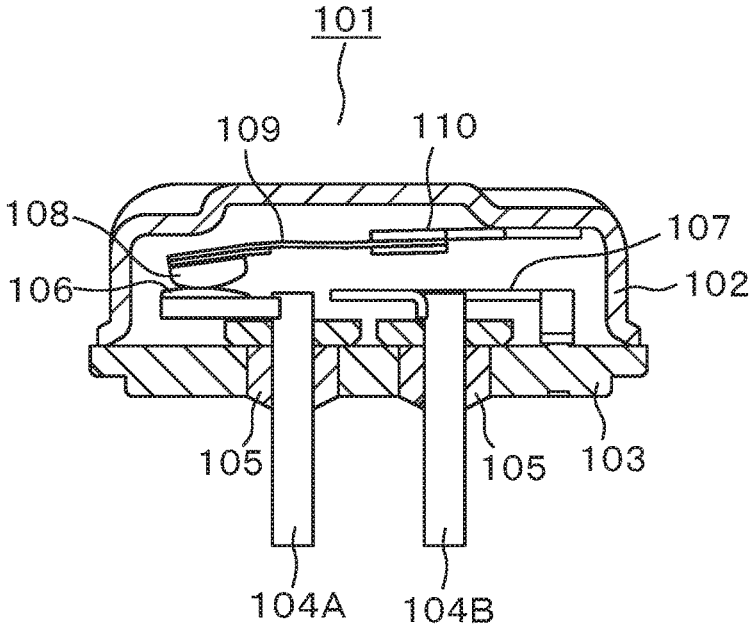
FIG. 6 Prior Art
FIG. 6 is a longitudinal section of a conventional heat-reactive switch.
Figure 7:
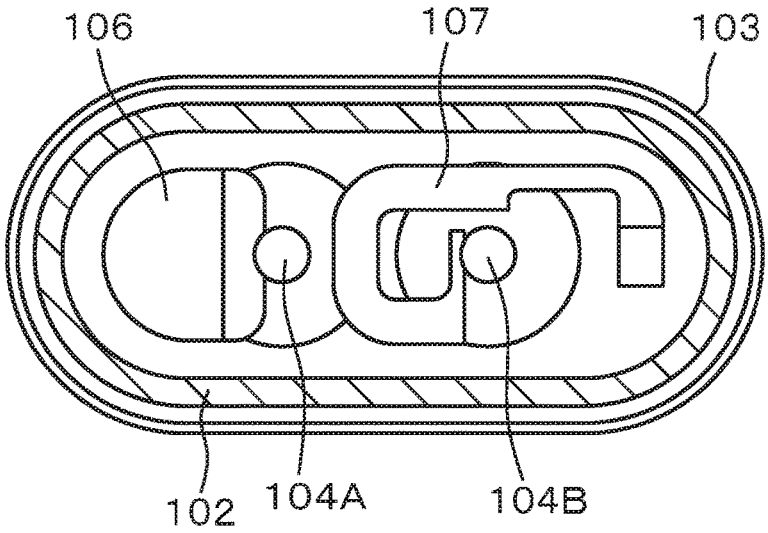
FIG.7 Prior Art
FIG. 7 is a cross-sectional view of the conventional heat-reactive switch.

The meandering portions 7C, 7D are bent with respect to predetermined reference axes 7H shown in FIG. 5. In this case, the reference axis 7H is an axis that extends in the longitudinal direction of the long dome-shaped housing 2. The reference axis 7H set in this manner is an axis that extends in a direction perpendicular to the center axis of the linear portion 7A, in other words, to the extending direction of the linear portion 7A. Also, the reference axis 7H is an axis extending in a direction perpendicular to the extending direction of the connection portion 7E, which connects the meandering portions 7C, 7D. Note that in the meandering portion 7D, the heater unit of a part facing the fixing portion 7F includes the linear portion 7A shorter than the linear portion 7A of the other heater units.

The meandering portions 7C, 7D are bent with respect to the reference axes 7H, such that a first surface of both surfaces of the linear portion 7A faces the same first surface. In other words, the meandering portions 7C, 7D are bent 180 degrees with respect to the reference axes 7H. In the meandering portions 7C, 7D bent in this manner, a predetermined gap is formed between opposite planes of the first surface of the same linear portion 7A, that is, between surfaces on the inner side in the bent state. Additionally, the meandering portions 7C, 7D are configured such that the respective strip-shaped flat parts constituting the linear portions 7A face each other. Also, the meandering portions 7C, 7D are bent such that the extending direction of the linear portion 7A is perpendicular to the connection portion 7E. Then, the heater 7 is arranged inside the airtight container such that the connection portion 7E is parallel to the inner surface of the lid plate 3. Accordingly, the heater 7 is arranged inside the airtight container such that the extending direction of the linear portion 7A is vertical to the inner surface of the lid plate 3.

By bending the meandering portions 7C, 7D in this manner, it is possible to reduce the dimension of the heater 7 in the width direction, which is the direction perpendicular to the reference axis 7H and the extending direction of the connection portion 7E. Hence, the heater 7 can be accommodated in a smaller space, and the heater 7 having a longer overall length can be arranged inside a conventional-sized airtight container. Also, the heater 7 having the meandering portions 7C, 7D bent in this manner is arranged inside the airtight container, such that the linear portion 7A of one meandering portion 7C faces the linear portion 7A of the other meandering portion 7D. Additionally, the heater 7 is arranged inside the airtight container, such that the linear portion 7A of one meandering portion 7C is parallel to the linear portion 7A of the other meandering portion 7D.

Also, when arranged inside the airtight container, the heater 7 surrounds the periphery of the conductive terminal pin 4B with the fixing portion 7G—the meandering portion 7C—the connection portion 7E—the meandering portion 7D—the fixing portion 7F. That is, the heater 7 is arranged around the conductive terminal pin 4B, in such a manner as to form a spiral. Additionally, the heater 7 is arranged such that the meandering portions 7C, 7D are opposite to each other with the conductive terminal pin 4B interposed therebetween. Also, the heater 7 is arranged such that the meandering portions 7C, 7D are parallel to the inner surface of the lid plate 3. The heater 7 is also arranged such that lateral surfaces on the outer sides of the meandering portions 7C, 7D are aligned with an inner circumferential surface of the housing 2. Then, the fixing portion 7G as an end part of the heater 7 on the circumferential edge side is fixed to the inner surface of the lid plate 3 by welding, for example. Meanwhile, the fixing portion 7F as an end part of the heater on the center side is fixed to an end part of the conductive terminal pin 4B inside the airtight container, by welding, for example.

Moreover, the heater 7 is arranged inside the airtight container such that the connection portion 7E is on the heat-reactive plate 9 side, a bent portion closest to the connection portion 7E is on the lid plate 3 side, and the next bent portion is on the heat-reactive plate 9 side. Hence, when the heater 7 is arranged inside the airtight container, its area is larger on the heat-reactive plate 9 side than on the lid plate 3 side opposite to the heat-reactive plate 9 side.

According to the heat-reactive switch 1, the heater element of the heater 7 has multiple meandering portions 7C, 7D formed of a strip-shaped metal plate. These meandering portions 7C, 7D are arranged parallel to at least the lid plate 3, between the lid plate 3 and the heat-reactive plate 9. Also, the meandering portions 7C, 7D are arranged opposite to each other with the conductive terminal pin 4B interposed therebetween. Also, each of the meandering portions 7C, 7D is aligned with the inner circumferential surface of the housing 2. Also, the meandering portions 7C, 7D are partially bent with respect to the reference axes 7H extending in the longitudinal direction of the housing 2. The meandering portions 7C, 7D are also configured such that their strip-shaped flat portions are opposite to each other. That is, according to the heat-reactive switch 1, by applying advantageous ideas to the shape of the heater 7, it is possible to reduce the cross-sectional area and extend the overall length of the heater 7. Hence, the heating value of the heater 7 can be increased.

In a deployed state, a heater formed into a strip shape is likely to receive force in a direction perpendicular to the surface of the heater, and therefore may easily warp. However, according to the heat-reactive switch 1 to which the present invention is applied, the meandering portions 7C, 7D as heating elements are bent with respect to the predetermined reference axes 7H. Additionally, the meandering portions 7C, 7D are bent with respect to the predetermined reference axes 7H, such that the extending direction of the linear portion 7A is vertical to the inner surface of the lid plate 3. Hence, force is less likely to be applied perpendicularly on the surfaces of the meandering portions 7C, 7D, and warpage resistance of the heater 7 can be improved.

Also, when vibration or impact is applied, a large stress acts on a fixing portion for fixing the heater. In particular, a configuration in which a heater projects largely in the lateral direction tends to be affected by vibration, since the center of gravity of the heater is separated from the fixing portion. Hence, when vibration or impact is applied, a large rotary torque acts on the fixing portion, and durability thereof is degraded. However, according to the heat-reactive switch 1 to which the present invention is applied, the heater 7 is partially bent, and therefore does not largely project in the lateral direction. Also, the heater 7 is arranged in such a manner as to form a spiral parallel to the lid plate 3, and its fixing portion 7F on the center side is fixed to the conductive terminal pin 4B. According to this configuration, the fixing portion 7F is positioned close to the center of gravity of the heater 7. Hence, even when vibration or impact is applied, the fixing portion 7F is less likely to receive an excessive rotary torque.

Also, the heater 7 is formed into a spiral as a whole, and the fixing portions 7F, 7G on both end parts are arranged at a predetermined interval in the longitudinal direction of the heat-reactive switch 1. In other words, the heater 7 has an asymmetrical shape as a whole. In addition, since the heater 7 has the meandering portions 7C, 7D as heating elements bent in a complex manner, lengths and directions of the parts are varied in many ways. This can suppress occurrence of resonance phenomena in the heater 7 due to vibration or the like.

Note that the present invention is not limited only to the single embodiment described above, and various modifications or extensions can be made without departing from the gist of the invention. For example, the number of meandering portions of the heater is not limited to two, and may be varied as appropriate.

The invention claimed is:

1. A heat-reactive switch, comprising:

an airtight container formed by adhering a lid plate in an airtight manner to an open end of a metallic, long, dome-shaped housing;

first and second conductive terminal pins respectively inserted into first and second through holes in the lid plate, wherein each of the first and second conductive terminal pins are fixed in an airtight manner by an electrical insulating filler;

a fixed contact fixed to the first conductive terminal pin inside the airtight container;

a heater having a first end connected to the second conductive terminal pin and a second end connected to the lid plate inside the airtight container;

a heat-reactive plate having a first end connected to an inner surface of the housing, wherein a curving direction of the heat-reactive plate is reversed at a predetermined temperature; and a movable contact provided on a second end of the heat-reactive plate and constituting a pair of switching contacts with the fixed contact, wherein:

a heating element of the heater has a plurality of meandering portions formed of a strip-shaped metal plate and is arranged parallel to and between the lid plate and the heat-reactive plate; and the meandering portions are arranged such that at least two of the meandering portions are opposite to each other with the second conductive terminal pin interposed therebetween, each aligned with an inner circumferential surface of the housing, each bent with respect to two reference axes extending in the longitudinal direction of the housing, so that first surfaces of the meandering portions face each other, and each of the meandering portions is bent twice with respect to the two reference axes, respectively.

2. The heat-reactive switch according to claim 1, wherein the meandering portions are formed by alternately connecting a plurality of heater units, each including a linear portion and a semicircular portion.

3. The heat-reactive switch according to claim 2, wherein the meandering portions are bent such that adjacent linear portions define first surfaces that face one another.

4. The heat-reactive switch according to claim 2, wherein the meandering portions are bent such that an extending direction of the linear portion is vertical to an inner surface of the lid plate.

5. The heat-reactive switch according to claim 2, wherein a first linear portion is arranged parallel to a second linear portion.

6. The heat-reactive switch according to claim 1, wherein the heater has a first end part on a circumferential edge side fixed to the lid plate and a second end part on a center side fixed to the second conductive terminal pin.

* * * * *